United States Patent [19]

Matsumoto et al.

[11] 4,270,959

[45] Jun. 2, 1981

[54] METHOD FOR THE HEAT TREATMENT OF METAL STRIP

[75] Inventors: Masahiro Matsumoto; Kenji Kawate; Hidenobu Jinnouchi, all of Nagoya, Japan

[73] Assignee: Daido Tokushuko Kabushiki Kaisha, Japan

[21] Appl. No.: 63,508

[22] Filed: Aug. 3, 1979

[30] Foreign Application Priority Data

Aug. 6, 1978 [JP] Japan ..... 53-95626

[51] Int. Cl.[3] ..... C22F 1/04; C21D 9/46

[52] U.S. Cl. ..... 148/153; 148/155; 148/156; 266/102; 266/103; 266/110; 266/111; 432/8; 432/58; 432/145

[58] Field of Search ..... 148/13, 145, 153, 155, 148/156; 266/102, 103, 110, 111; 432/8, 58, 59, 145

[56] References Cited

U.S. PATENT DOCUMENTS

| | | | |
|---|---|---|---|
| 1,948,173 | 2/1934 | Hagan | 432/8 X |
| 2,205,915 | 6/1940 | Wean et al. | 148/156 |
| 2,319,302 | 5/1943 | Cook | 423/8 X |
| 2,673,080 | 3/1954 | Hepburn et al. | 266/103 X |
| 2,983,497 | 5/1961 | Dailey | 148/156 X |
| 3,048,383 | 8/1962 | Champlin | 266/111 |
| 3,877,867 | 4/1975 | Tscuchiya et al. | 266/103 X |
| 4,106,757 | 8/1978 | Jackson | 266/103 |
| 4,148,600 | 4/1979 | Croft et al. | 266/111 X |

FOREIGN PATENT DOCUMENTS

| | | | |
|---|---|---|---|
| 890804 | 9/1953 | Fed. Rep. of Germany | 148/156 |

*Primary Examiner*—R. Dean
*Assistant Examiner*—W. G. Saba
*Attorney, Agent, or Firm*—William A. Drucker

[57] ABSTRACT

During the process in which a metal strip is moved in a floating condition, the metal strip is first heated, and thereafter cooled and annealed. In heating the metal strip, the metal strip is heated so that a central portion widthwise thereof is increased in temperature more than that of both edges widthwise thereof. The metal strip is heated in a manner as described whereby a great thermal stress is not introduced in the metal strip and consequently, there is less possibility to produce wrinkles in the metal strip.

5 Claims, 12 Drawing Figures

METHOD FOR THE HEAT TREATMENT OF METAL STRIP

BACKGROUND OF THE INVENTION

1. Field of the Invention

The present invention relates to a method for the heat treatment of metal strips such as aluminum, copper and iron strips, the method comprising heating such metal strips while being passed through a heating zone, and then cooling the strips while being passed through a cooling zone, thereby applying heat treatment such as annealing to the metal strips.

2. Description of the Prior Art

In the prior arts, in the case where a metal strip (The term "metal strip" as used herein indicates a thin and lengthy band-like metal plate continuously rolled by a rolling mill. The thickness of the metal plate is normally less than 3.5 mm, and the plate has various widths.) is subject to heat treatment as mentioned above, great thermal stresses are introduced in the strip as indicated at the dotted lines in FIG. 6 or FIG. 9, and when the thermal stress overcomes the antibuckling stress of the metal strip, it gives rise to wrinkles, in the metal strip, in parallel to the moving direction thereof. These wrinkles result in a defective metal strip.

SUMMARY OF THE INVENTION

It is therefore an object of the present invention to provide a method for the heat treatment which in the heating process of metal strip, can minimize the amplitude of thermal stress introduced in the metal strip to obtain a finished product of good quality without wrinkles.

BRIEF DESCRIPTION OF THE DRAWINGS

FIG. 2-2 is a sectional view showing an embodiment in which the plenum chamber is differently divided;

FIG. 3-3 is a sectional view showing another embodiment in which the plenum chamber is differently divided;

DESCRIPTION OF THE PREFERRED EMBODIMENTS

Figure 1:
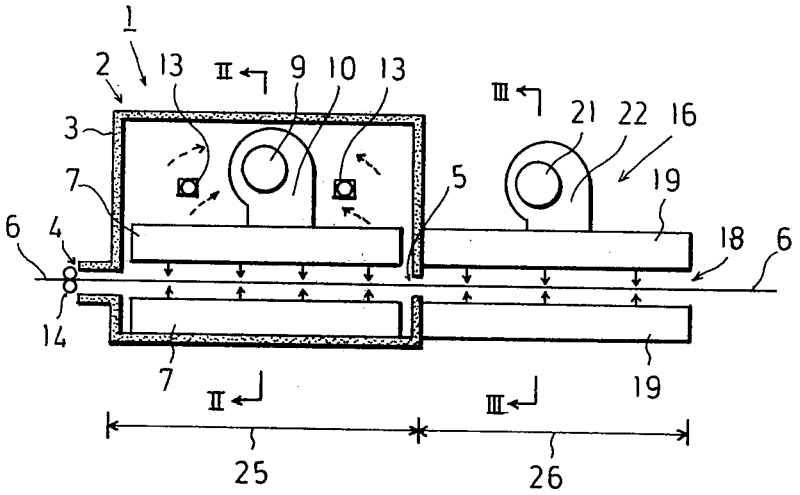
FIG. 1 is a schematic longitudinal sectional view of a heat treatment apparatus.
Figure 2:
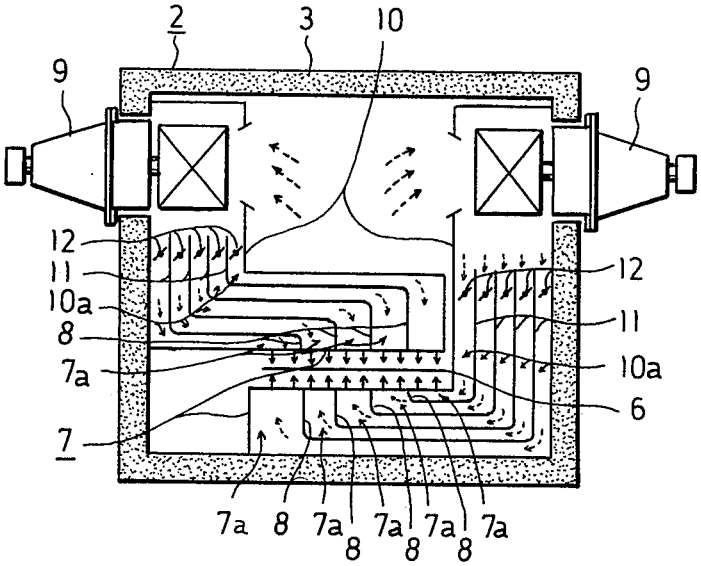
FIG. 2 is an enlarged sectional view taken on line II—II.
Figure 2:
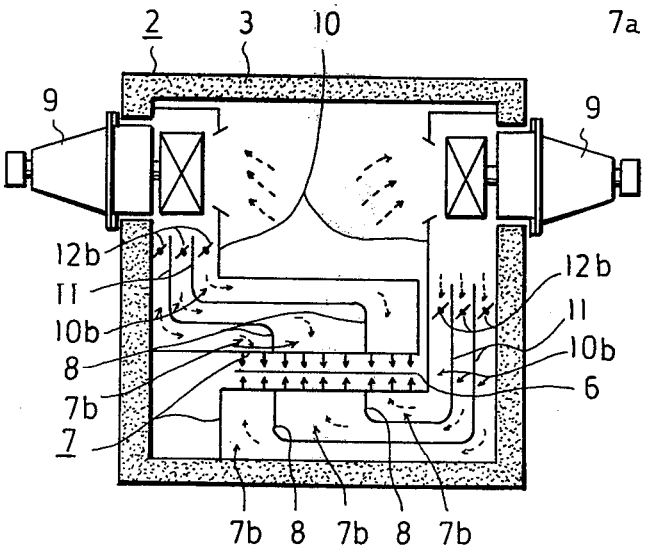

Referring now to FIG. 1, heat treatment apparatus 1 consists of a heating apparatus 2 and a cooling apparatus 16. First, the heating apparatus 2 will be explained. The longitudinal section of the heating apparatus 2 is shown in FIG. 2. As is known, a furnace wall 3 is designed so as to form a heat shielding between the interior and exterior thereof. The furnace wall 3 has a part formed with an entrance port 4 and a reception port 5. A metal strip 6 is inserted through the entrance port 4 and reception port 5 as shown. The furnace wall 3 has plenum chambers 7 and 7 provided in a space interiorly thereof. These plenum chambers 7 and 7 are disposed opposedly in a position through which the metal strip 6 passes, and the plenum chambers 7 and 7 have their surfaces opposed to each other provided with a plurality of gas blowing nozzles in a known manner. The plenum chamber 7 is divided by means of partitioning walls 8, 8 . . . into a plurality of chamber elements 7*a*, 7*a* . . . arranged side by side widthwise of the metal strip 6. A recirculation fan 9 is mounted on the furnace wall 3. One end of a conduit 10 is communicated with the recirculation fan 9 and the other end thereof is communicated with the plenum chamber 7. The conduit 10 is interiorly partitioned by means of partitioning walls 11, 11 . . . and divided into a plurality of conduit elements 10*a*, 10*a* . . . The partitioning walls 11, 11 . . . are individually continuous to the partitioning walls 8, 8 . . . of the plenum chamber 7, and the conduit elements 10*a*, 10*a* . . . are individually communicated with the chamber elements 7*a*, 7*a* . . . The conduit elements 10*a*, 10*a* . . . are respectively provided with dampers 12, 12 . . . which control the quantity of gas. The furnace wall 3 is internally provided with a burner 13. Entrance rolls 14 are disposed frontwardly of the entrance port 4. The entrance rolls 14 are provided to steadily guide the metal strip 6 towards the entrance port 4.

Next, the cooling apparatus 16 will be explained. This cooling apparatus 16 is constructed equally to the heating apparatus 2 as will be understood from the longitudinal section shown in FIG. 3. That is, the cooling apparatus comprises a frame 17, a plenum chamber 19, an air blower 21 and a conduit 22. The plenum chamber 19 is divided by means of partitioning walls 20, 20 . . . into a plurality of chamber elements 19*a*, 19*a* . . . , and likewise, the conduit 22 is also divided by means of partitioning walls 23, 23 . . . into a plurality of chamber elements 22*a*, 22*a* . . . The conduit elements 22*a*, 22*a* . . . have dampers 24, 24 . . . , respectively, disposed therein. A discharge port for the metal strip 6 in the cooling apparatus 16 is indicated at 18. The plenum chambers 7, 19 and conduits 10, 22 are provided with customary means so that the quantity of gases blown from the number of nozzles towards the metal strip 6 may be adjusted for every portion along the moving direction of the metal strip 6.

Figure 4:
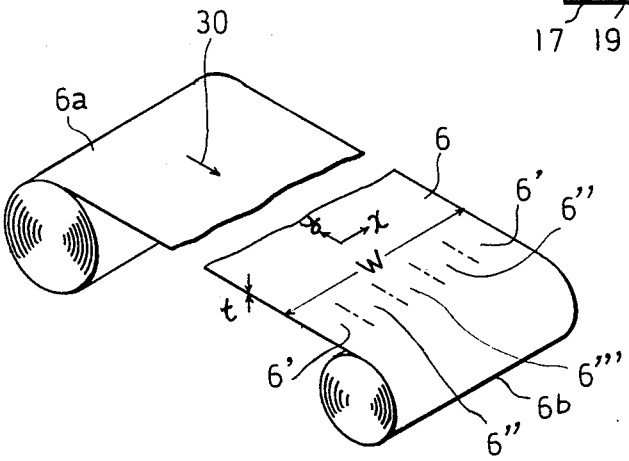
FIG. 4 is a schematic perspective view showing a state wherein the metal strip is paid off and rewound.

Next, the operation of the apparatus will be described. A metal strip 6*a* wound as shown in FIG. 4 about a pay-off reel in a known manner is paid off as shown by the arrow 30. After the thus paid off metal strip 6 has been passed through various known devices, it is inserted through the heating apparatus 2 and then through the cooling apparatus 16 in the heat treatment apparatus 1. The metal strip 6 issued from the heat treatment apparatus 1 passes through various known devices and thereafter, it is rewound about a rewind reel as shown at 6*b* in a known manner.

In a state wherein the metal strip 6 is inserted through the heat treatment apparatus 1 as described above, the burner 13, and air blowers 9, 21 are operated. In the steady condition, the metal strip between the plenum chambers 7, 7 and between chambers 19, 19 is held in a floating condition by heating hot gases blown through the nozzles on the chambers 7 or cooling gases blown through the nozzles on the chambers 19, for example, normal air not heated. It will be noted that members such as air blowers, chambers, burner and the like in the heating apparatus 2 and cooling apparatus 16 are designed so as to perform the aforementioned function and to increase and decrease temperatures of the metal strip 6 as will be described later.

The metal strip 6 passing through the heat treatment apparatus 1 while maintaining a floating condition as described above is heated by the heating apparatus 2 and then cooled by the cooling apparatus 16. In FIG. 1, a heating zone and a cooling zone are respectively designated at 25 and 26.

Figure 5:
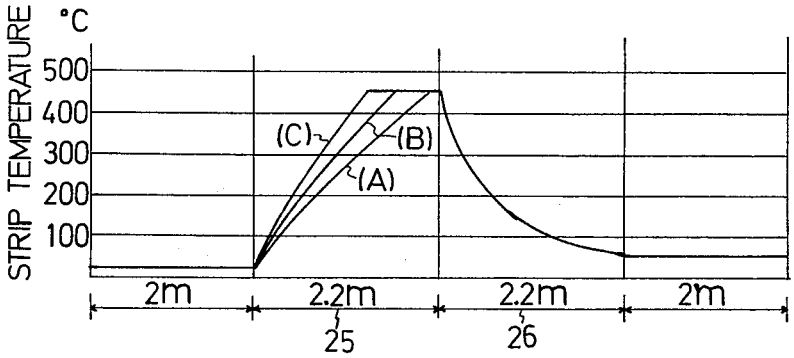
FIG. 5 is a graphic representation showing one example of changes in temperature of an aluminum strip.

In the heat treatment of an aluminum strip as one example of the metal strip 6, one example of changes in temperature of the aluminum strip is shown in FIG. 5. That is, in the heating zone 25, the aluminum strip 6 is heated in a manner such that both edges 6′ are increased in temperature most gently as shown at (A), a central portion 6‴ is increased in temperature most quickly as shown at (C), and intermediate portions 6″ therebetween are increased in temperature at an about intermediate rate between the aforesaid (A) and (C) as shown at (B). On the other hand, in the cooling zone 26, the whole width of the aluminum strip 6 is uniformly cooled. The adjustment in the heating zone 25 as described above can be accomplished by adjusting openings of the plurality of dampers 12. That is, the adjustment of respective openings of the dampers 12 causes to increase the quantity of heating gases blown from the chamber element 7*a* opposed to the central portion 6‴ widthwise of the strip, to decrease the quantity of heating gases blown from the chamber elements 7*a*, 7*a* opposed to both edges 6′, 6′ widthwise of the strip, and to make the quantity of gases blown from the chamber elements 7*a*, 7*a* opposed to the intermediate portions between the central portion and both edges of the strip nearly half. With this, the strip being heated is increased in temperature at the central portion 6‴ quickly as compared to the temperature of both edges 6′, 6′. The dimensions of various members are that the aluminum strip is 0.3 t×2000 W, the length of the heating zone 25 is 2.2 m, and the length of the cooling zone 26 is 2.2 m.

Figure 6:
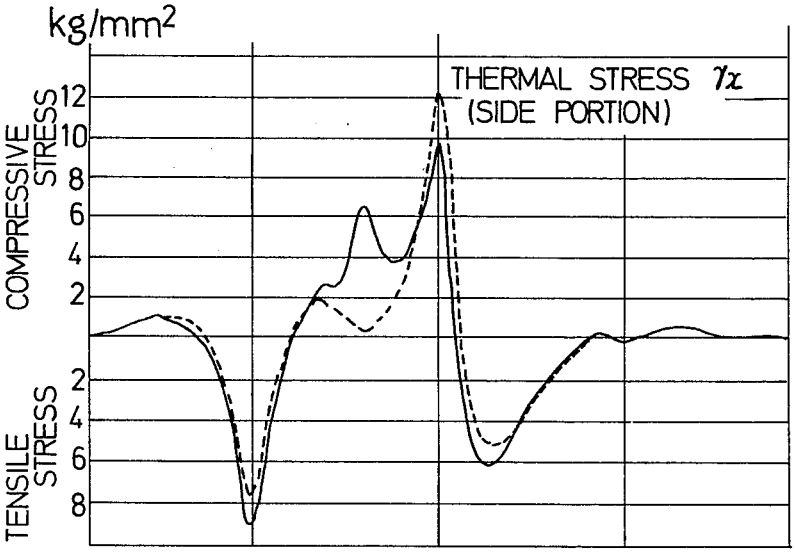
FIGS. 6 and 7 are graphic representations showing a state wherein a thermal stress is introduced in the case the temperature of the aluminum strip is changed as shown in FIG. 5.
Figure 7:
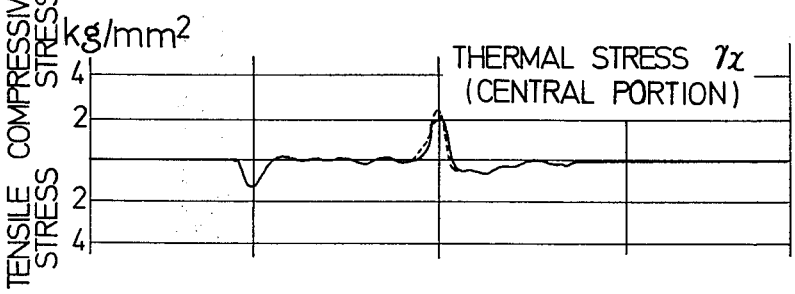

When the aluminum strip is heated and cooled as previously described, thermal stresses as shown by the solid lines in FIGS. 6 and 7 are introduced in the edges and central portion, respectively, of the aluminum strip. In FIGS. 6 and 7, thermal stresses introduced in the aluminum strip when the latter is uniformly heated and then cooled over the whole width thereof are shown by the broken lines. As can be seen from FIGS. 6 and 7, in the case the aluminum strip is heated in the heating zone 25 in a manner such that the central portion 6‴ thereof is increased in temperature quickly as compared to both edges 6′, the thermal stress introduced in the aluminum strip is within the range of low value. This low-value thermal stress does not generally exceed the elastic limit of the aluminum strip. Accordingly, there is not produced so large a wrinkle as to impair a value of product in the aluminum strip.

Figure 8:
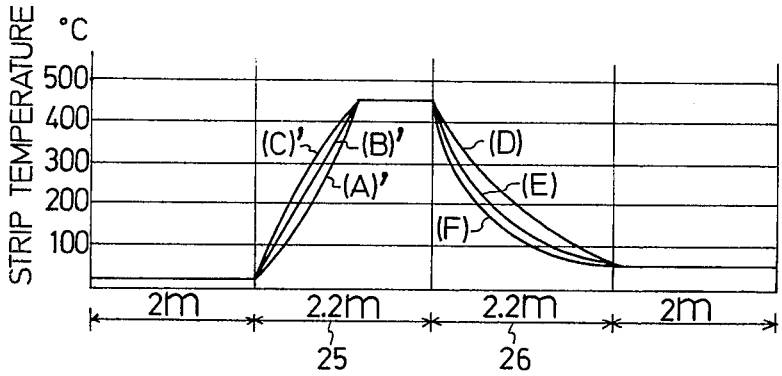
FIG. 8 is a graphic representation showing a further example of changes in temperature of an aluminum strip.
Figure 9:
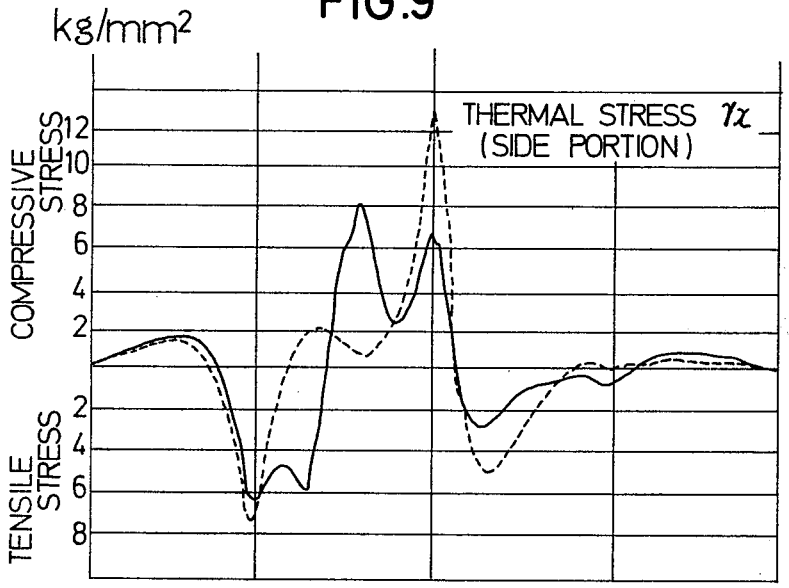
FIGS. 9 and 10 are graphic representations showing a state wherein a thermal stress is introduced in the case the temperature of the aluminum strip is changed as shown in FIG. 8.
Figure 10:
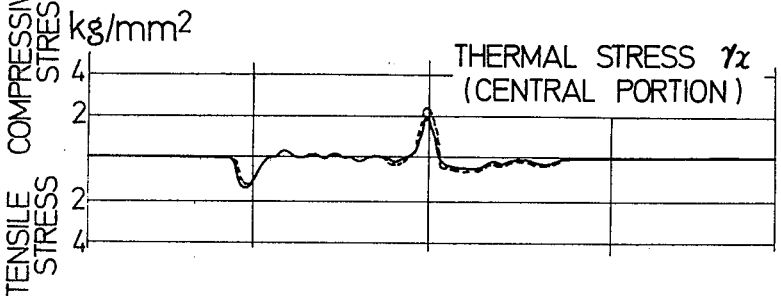

FIGS. 8 through 10 show how temperatures change and how the stress is introduced in the strip in the case the aluminum strip is heated and cooled in a condition of changes in temperature different from that of the preceding embodiment.

In the heating zone 25, the aluminum strip is heated in a manner such that both edges 6′, 6′ are changed in temperature as shown at (A)′, the central portion 6‴ at (C)′, and intermediate portions 6″, 6″ therebetween at (B)′. Then, in the cooling zone 26, the strip is cooled in a manner such that the central portion 6‴ is lowered in temperature most gently as shown at (D), both edges 6′, 6′ are lowered in temperature most quickly as shown at (F), and the intermediate portions 6″, 6″ are lowered in temperature at an about intermediate rate between the aforesaid (D) and (F) as shown at (E). Such adjustment can be accomplished by adjusting openings of dampers 24 in the cooling apparatus 16 in a manner similar to that of the above-mentioned heating apparatus.

When the aluminum strip is heated and cooled as described above, thermal stresses as shown by the solid lines in FIGS. 9 and 10 are introduced in the aluminum strip. This thermal stress is within the range of lower value than that of the preceding embodiment as compared to the thermal stress (shown by the broken lines) produced when the whole width of the aluminum strip is uniformly heated and cooled. Accordingly, wrinkles are less produced in the aluminum strip.

The upper and lower plenum chambers 7, 7 in the heating apparatus have been respectively divided into five sections widthwise of the strip in the preceding embodiments. However, it should be noted that as shown in FIG. 2-2, the plenum chamber 7 may also be divided into three chamber elements 7*b*, 7*b* and 7*b* opposed to the central portion and both edges of the strip. In this case, the quantity of heating gases blown from the chamber elements 7*b* is such that the openings of respective dampers 12*b* may be adjusted to decrease the quantity of gases blown from the chamber elements opposed to the both edges of the strip and to increase the quantity of gases blown from the chamber element opposed to the central portion of the strip.

Figure 3:
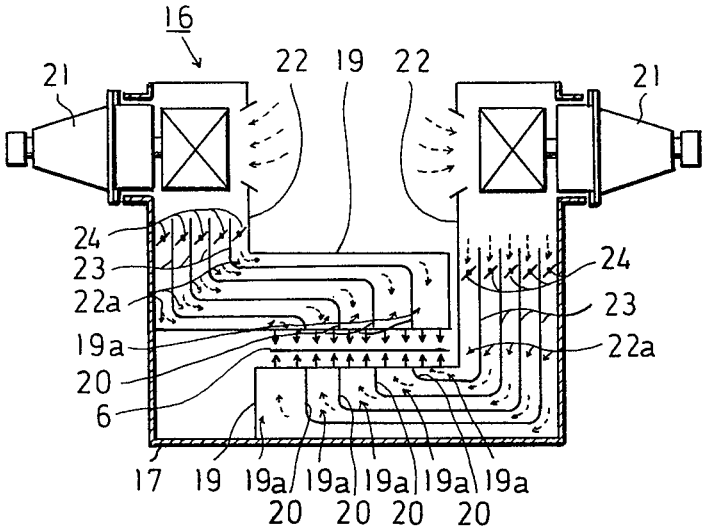
FIG. 3 is an enlarged sectional view taken on line III—III.
Figures 2, 3:
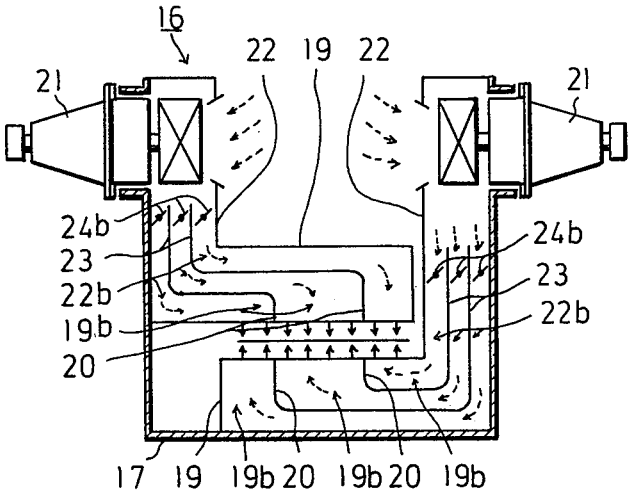

Likewise, the plenum chamber 19 in the cooling apparatus 16 may be divided into three chamber elements 19*b*, 19*b* and 19*b* as shown in FIG. 3-2. In this case, the quantity of cooling gases (air) blown from the chamber elements 19*b* is such that the openings of respective dampers 24*b* may be adjusted to decrease the quantity of gases blown from the chamber element opposed to the central portion of the strip and to increase the quantity of gases blown from the chamber elements opposed to the both edges of the strip.

It is understood that the term "edges of the metal strip" as herein used is intended to apply to the "terms in contrast" of the central portion of the metal strip. That is, the term "edges of the metal strip" indicates the portions to which the outermost chamber elements of five chamber elements shown in FIG. 2 are opposed, portions to which both outer chamber elements of three chamber elements shown in FIG. 2-2 are opposed, and the like.

What is claimed is:

1. A method, for the heat treatment of metal strip, comprising the steps of:

(i) passing a horizontally-disposed metal strip in floating condition horizontally through a heating zone, said floating condition and said heating being obtained by blowing heating gases towards the strip from a pair of plenum chambers arranged respectively above and below the strip, the quantities of gases blown towards a part of the length of the strip in which a thermal stress greater than an anti-buckling stress is produced in said heating zone being respectively larger for portions close to the central portion widthwise of the metal strip than for both edges widthwise of the metal strip, such that said central portion widthwise of the strip is higher in temperature than said both edges thereof, (ii) after said strip has passed through said heating zone, passing said strip in floating condition through a cooling zone.

2. The method, for the heat treatment of metal strip, as claimed in claim 1, wherein said step of passing said strip in floating condition through said cooling zone and cooling said strip includes moving said strip in horizontal condition horizontally between a pair of cooling plenum chambers arranged respectively above and below said strip and blowing cooling gases from said plenum chambers onto said strip, the blowing being arranged such that, for a part of the length of the strip in which a thermal stress greater than an anti-buckling stress is produced in said cooling zone, the metal strip is cooled so that both edges widthwise thereof are lower in temperature than a central portion widthwise thereof.

3. The method for the heat treatment of metal strip as claimed in claim 2, wherein said step of blowing heating gases from said pair of upper and lower plenum chambers towards the metal strip includes blowing heating gases from three chambers, which are formed by dividing the plenum chamber into one chamber opposed to the central portion widthwise of the metal strip and two chambers opposed to the edges, respectively, of the metal strip, towards portions of the metal strip opposed thereto; and blowing a larger quantity of gases from said chamber opposed to the central portion of the metal strip than the quantity of gases from said chambers opposed to both edges; and wherein said step of blowing cooling gases from said pair of upper and lower plenum chambers towards the metal strip includes blowing cooling gases from three chambers, which are formed by dividing the plenum chamber into one chamber opposed to the central portion widthwise of the metal strip and two chambers opposed to the edges, respectively, of the metal strip, towards portions of the metal strip opposed thereto; and blowing a larger quantity of cooling gases from said chambers opposed to both edges of said metal strip than the quantity of gases from said chamber opposed to the central portion.

4. The method for the heat treatment of metal strip as claimed in claim 2, wherein said step of blowing heating gases from said pair of upper and lower plenum chambers towards the metal strip includes blowing heating gases from respective five chambers, which are formed by dividing respective plenum chambers into a chamber opposed to the central portion of the metal strip, two chambers opposed to the edges of the metal strip, and two chambers opposed to intermediate portions between the central portion and edges of the metal strip, towards the respective opposed portions of the metal strip;

blowing a larger quantity of heating gases from said chambers opposed to said intermediate portions of said metal strip than the quantity of gases from the chambers opposed to the both edges; and blowing a larger quantity of heating gases from the chambers opposed to said central portion than the quantity of gases from the chambers opposed to the intermediate portion, and wherein said step of blowing cooling gases from said pair of upper and lower plenum chambers towards the metal strip includes blowing cooling gases from respective five chambers, which are formed by dividing respective plenum chambers into a chamber opposed to the central portion of the metal strip, two chambers opposed to the edges of the metal strip, and two chambers opposed to intermediate portions between the central portion and edges of the metal strip, towards the respective opposed portions of the metal strip;

blowing a larger quantity of cooling gases from said chambers opposed to said intermediate portions of said metal strip than the quantity of gases from the chambers opposed to the central portion; and blowing a larger quantity of cooling gases from said chambers opposed to said edges than the quantity of gases from the chambers opposed to the intermediate portions.

5. The method for the heat treatement of metal strip as claimed in claim 4, wherein said step of blowing heating gases from respective five chambers in said pair of upper and lower plenum chambers includes feeding heating gases from air blowers each being disposed in each plenum chamber, into each chamber of said plenum chambers, through individual conduits individually communicated with each of said chambers; and adjusting the quantity of heating gases fed into each of plenum chambers through conduits by dampers each being disposed in each conduit; and wherein said step of blowing cooling gases from respective five chambers in said pair of upper and lower plenum chambers includes feeding cooling gases from air blowers each being disposed in each plenum chamber, into each chamber of said plenum chambers, through individual conduits individually communicated with each of said chambers; and adjusting the quantity of cooling gases fed into each of plenum chambers through conduits by dampers each being disposed in each conduit.

* * * * *

UNITED STATES PATENT AND TRADEMARK OFFICE

CERTIFICATE OF CORRECTION

PATENT NO. : 4,270,959

DATED : June 2, 1981

INVENTOR(S) : Matsumoto et al.

It is certified that error appears in the above-identified patent and that said Letters Patent are hereby corrected as shown below:

On The Title Page Item (73), should read

-- (73) Assignee: Daidotokushuko Kabushikikaisha, Japan
and
Sumitomokeikinzokukogyo Kabushikikaisha, Japan --.

Signed and Sealed this

*Thirteenth* Day of *April 1982*

[SEAL]

*Attest:*

GERALD J. MOSSINGHOFF

*Attesting Officer*

*Commissioner of Patents and Trademarks*